United States Patent [19]

Molloy

[11] 4,045,921

[45] Sept. 6, 1977

[54] ALIGNMENT DEVICE FOR TELESCOPING GYMNASIUM SEATING

[75] Inventor: Richard P. Molloy, Portage, Mich.

[73] Assignee: Interkal, Inc., Kalamazoo, Mich.

[21] Appl. No.: 707,611

[22] Filed: July 22, 1976

[51] Int. Cl.[2] ..... E04H 3/12

[52] U.S. Cl. ..... 52/9

[58] Field of Search ..... 52/9, 10, 183; 182/131

[56] References Cited

U.S. PATENT DOCUMENTS 3,389,511 6/1968 Drehobl ..... 52/9

FOREIGN PATENT DOCUMENTS 1,213,591 3/1963 Germany ..... 52/9

*Primary Examiner*—Ernest R. Purser
*Assistant Examiner*—Carl D. Friedman
*Attorney, Agent, or Firm*—Blanchard, Flynn, Thiel, Boutell & Tanis

[57] ABSTRACT

A telescoping gymnasium seating unit including a plurality of movable upright frames respectively sized and movable between a first position wherein the frames are nested one in the other when fully telescoped and a second position wherein the frames are unnested. Each of the frames has a seating member thereon with an upwardly facing horizontal planar-like seating surface. Each of the seating members on each of the frames is vertically offset from a seating member on a mutually adjacent frame in the second position of the frames. The seating members are vertically spaced one above the other when the frames are in the first position and have a vertical spacing therebetween. Low friction devices are secured to the seating members and extend downwardly therefrom and engage the next seating member located therebelow when the frames are in the first position to maintain the vertical spacing therebetween uniform when vertical loads are applied to the seating members when the frames are in the first position.

4 Claims, 4 Drawing Figures

ALIGNMENT DEVICE FOR TELESCOPING GYMNASIUM SEATING

FIELD OF THE INVENTION

This invention relates to an improvement in a telescopic bleacher construction, an example of which is illustrated in U.S. Pat. No. 3,389,511 and, more particularly, to an arrangement for maintaining a uniform vertical spacing between the seating members on the telescoping gymnasium seating unit when the frames thereof are fully telescoped one within the other.

BACKGROUND OF THE INVENTION

A common practice in school gymnasiums and similar auditoriums is to install retractable telescoping bleacher constructions. These constructions ordinarily are comprised of a plurality of movable, upright frames or sections respectively sized to nest one within the other when fully telescoped. The rearmost upright frame or section is ordinarily fixed to the auditorium wall while the remaining frames are movable inwardly and outwardly relative to the wall to shift the structure from such fully telescoped position to an extended position in which the upright frames or sections are positioned successively in a forwardly extended adjacent relation to each other. The sections carry suitable seatboards and footboards in suitable spaced relation to provide a tierlike seating structure. Because of the space requirements and limitations, as well as the varied activities conducted in such auditoriums of the present day crowded educational plants, it is frequently necessary, several times a day in some schools, to maneuver the bleacher structure into and out of its proper extended position on the gymnasium floor. In addition, the bleacher structure, when in the fully telescoped position is subjected to stresses from time to time by students or others less respectful of the seating equipment climbing onto the uppermost one of the telescoped sections before it is properly supported on the floor of the gymnasium in the fully extended position. This can effect a bending of the frame and results in the vertical spacing between the seating members on each of the movable frames becoming nonuniform and, therefore, unattractive when the frames are in the fully telescoped position. It is desirable, therefore, to provide an inexpensive means of maintaining a uniform spacing between the seating members on the frame in a telescoping gymnasium seating unit without appreciably increasing the cost of the overall structure, such as would be the situation if the strength of the frames was increased to withstand the loads.

Accordingly, it is an object of this invention to provide low friction means secured to the seating members and extending downwardly therefrom and engaging the next seating surface of the seating member located therebelow when the frames are in the fully telescoped position to maintain the aforesaid vertical spacing uniform between the seating members when vertical loads are applied to the seating devices when the frames are still in the telescoped position.

It is a further object of this invention to provide an inexpensive roller rotatably supported in a bracket which is secured to the seating members, which roller engages the upwardly facing seating surface of a seating member located therebelow so that vertical loads applied to the uppermost seating member is applied through the roller to the next lower seating device.

It is a further object of this invention to provide a low friction device, as aforesaid, which is simple in construction, highly durable and offering little or no maintenance problem and which will not marr the seating surface of the seating members.

SUMMARY OF THE INVENTION

The objects and purposes of the invention are met by providing in a telescoped gymnasium seating unit a plurality of movable upright frame means respectively sized and movable between a first position wherein the frame means are nested one in the other when fully telescoped and a second position wherein the frame means are unnested, each of the frame means having seating means thereon with an upwardly facing horizontal planarlike seating surface thereon, each of the seating means on each of the frame means being vertically offset from a seating means on a mutually adjacent frame means in the aforesaid second position of the frame means and being vertically spaced one above the other in the first position and having a vertical spacing therebetween. The telescoping gymnasium seating unit also has low friction means secured to the seating means and extending downwardly therefrom and engaging the next seating means located therebelow when the frame means are in the first position to maintain the vertical spacing uniform between the seating means when vertical loads are applied to the seating means.

Other objects and purposes of this invention will be apparent to persons acquainted with apparatus of this general type upon reading the following specification and inspecting the accompanying drawing, in which.

Figures 1, 2, 3, 4:
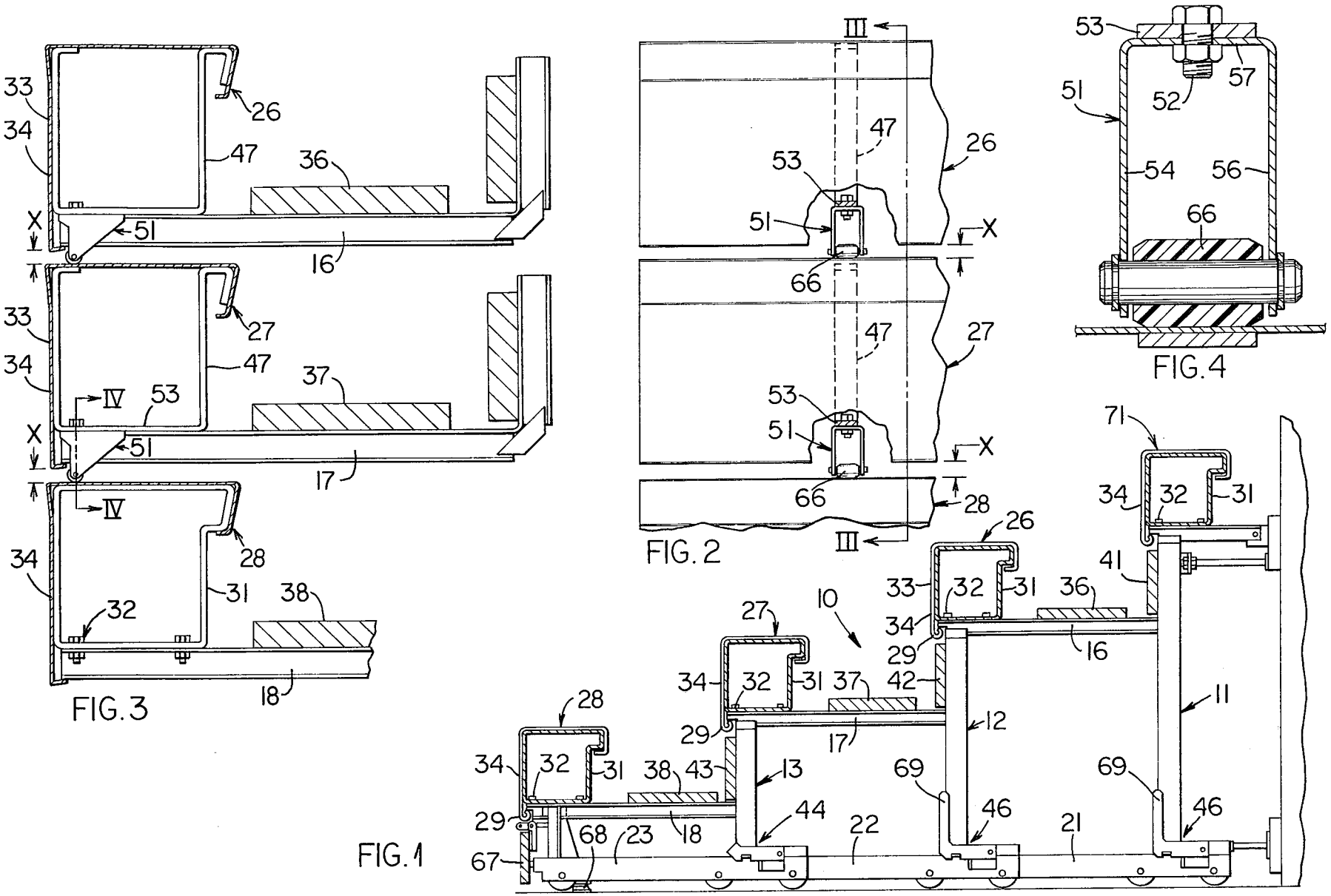
FIG. 1 is a fragmentary vertical sectional view taken through a four-tiered telescopic bleacher construction embodying the invention.
FIG. 2 is a front elevational view of a portion of the bleacher construction adjacent one end thereof.
FIG. 3 is a sectional view taken along the line III—III of FIG. 2.
FIG. 4 is a sectional view taken along the line IV—IV of FIG. 3.

Certain terminology will be used in the following description for convenience in reference only and will not be limiting. The words "up," "down," "right" and "left" will designate directions in the drawings to which reference is made. The words "in" and "out" will refer to directions toward and away from, respectively, the geometric center of the device and designated parts thereof. Such terminology will include derivatives and words of similar import.

DETAILED DESCRIPTION

Referring to FIG. 1, the invention illustrated herein is embodied in a telescopic bleacher structure 10 generally is identical to that illustrated in U.S. Pat. No. 3,389,511. The bleacher structure 10 is comprised of a plurality of movable sections each including upright frames 11, 12 and 13 having upper horizontal support members 16, 17 and 18, respectively, and lower horizontal support members 21, 22 and 23, respectively, rigidly mounted thereto and extending forwardly therefrom. A plurality of seating members or seatboard-skirtboard combinations 26, 27 and 28 are mounted on the forward portion of each of the upper horizontal support members 16, 17 and 18, respectively, so that the skirtboard portion 34 thereof is substantially flush with the front edge of the upper support member. A hook portion 29 may be provided along the lower edge of the skirtboard portion 34 to hook over the front edge of the upper support member to absorb rearward forces in the direction of arrow A in FIG. 1. In this particular embodiment, as is also illustrated in the aforementioned U.S. patent, the seatboard-skirtboard combinations 26, 27 and 28 are each composed of a bracket 31 which is secured to each of the upper support members 16, 17 and 18 by a plurality of screws 32 or the like. An elongated steel profile 33 is secured to and extends between a plurality of side-by-side arranged brackets 31 secured to side-by-side arranged upper support members 16, 17 and 18 across the lateral width of the bleacher structure 10. If desired, the steel profile 33 can be coated with a non-slip vinyl which offers an ideal walking surface and the possibility to color-coordinate the bleacher construction with the existing walls of the gymnasium facility. The frontmost surface 34 of the seatboard-skirtboard combinations 26, 27 and 28 become flush or coplanar when the frames are nested one within the other as illustrated in FIG. 3.

A plurality of footboards 36, 37 and 38 are mounted on top of the upper support members 16, 17 and 18, respectively intermediate the respective seatboard combinations and the immediately adjacent upright frames to the rear thereof, thus forming a tiered bleacher construction having telescoping sections movable in relation to each adjacent section from a fully telescoped position to the extended position illustrated in FIG. 1. For instance, the forwardmost section comprised of an upright frame 13, upper horizontal support member 18, lower horizontal support member 23, seatboard combination 28 and footboard 38, form a bleacher section which nests in the immediately adjacent bleacher section to the rear thereof which is comprised of upright frame 12, upper support member 17, lower support member 22, etc., and so on until the bleacher sections are successively moved to their fully telescoped position schematically illustrated in FIG. 3. The height of the seatboard-skirtboard combination is such that the seatboard will pass under the upper horizontal support member of the bleacher section immediately to the rear thereof. Skirtboard panels 41, 42 and 43 may be secured to each of the upright frames 11, 12 and 13, respectively, above the respective upper horizontal support member extending forwardly thereof.

The bleacher construction 10 is provided with a first tier locking device, generally designated 44 in FIG. 1 and a locking device 46 for each of the successive bleacher sections to the rear of said first tier as described in the aforementioned U.S. Pat. No. 3,389,511.

A pair of brackets 47 are secured to each end of the elongated seatboards 26, 27 and 28, however, only one such bracket is illustrated in FIGS. 2 and 3. Each bracket is generally U-shaped and is secured to the steel profile 33 on the inside thereof by means of screws or bolts not illustrated.

A generally U-shaped bracket 51 is secured by means of a bolt 52 to the lowermost leg 53 of the bracket 47. The U-shaped bracket 51 has a pair of parallel legs 54 and 56 and an interconnecting bight portion 57. The bight portion 57 has an opening therethrough which receives the bolt 52 for effecting a securement of the bracket 51 to the leg 53 of the bracket 47. Axially aligned openings 58 and 59 are provided in the legs 54 and 56, respectively, and are adapted to receive a pin 61 therethrough. The pin is of equal diameter throughout its entire length and has a pair of annular grooves 62 adjacent the ends thereof. The pin 61 is adapted to be received into the axially aligned openings 58 and 59 and the spacing between the annular grooves 62 is such that they are located on the outboard side of the legs 54 and 56. Spring clips 63 are received in the annular grooves 62 to effect a securement of the pin 61 to the legs 54 and 56 of the bracket 51. A low friction material roller 66 is rotatably supported on the pin 61 between the legs 54 and 56 of the U-shaped bracket 51. The height of the roller 66 and bracket 51 is such to maintain a predefined vertical spacing "X" (FIGS. 2 and 3) between the vertically spaced seatboard members 26, 27 and 28. This is accomplished by the roller 66 engaging the upper surface of the steel profile 33. Thus, any vertical load applied to any one of the seatboard members 26, 27 and 28 will be transmitted through the bracket 51 and roller 66 to the next adjacent lower seatboard member. A bracket 51 is secured to all but the uppermost one of the seatboard member 71 and the lowermost seatboard member 28.

OPERATION

To telescope the unit from the position illustrated in FIG. 1 into its retracted nested position schematically illustrated in FIG. 3, the front kickboard is, as is explained in the aforementioned U.S. Pat. No. 3,389,511, raised to disengage the locking pad 68 from engagement with the floor and also to trip the first locking means 44. As the first section is nested into the second section, and the second into the third and so on during the rearward travel of the bleacher sections, the forwardmost skirtboard 43, secured to the first upright frame 13, makes contact with the trip finger 69 of each succeeding locking means 46 tilting it upward until it is disengaged from the corresponding locking tab of the adjacent bleacher section. This tripping action repeats as each succeeding bleacher is telescoped, resulting in a sequence telescoping action beginning with the first row to the last row to the fully closed or fully telescoped position. The kickboard may again be lowered locking the bleachers in such fully closed telescoped position. As each bleacher section becomes telescoped, the bracket 51 and roller 66 becomes engaged with and rolls upon the upper surface of the next adjacent seatboard-skirtboard combination located therebelow to effect and maintain the aforementioned spacing X therebetween. As a result, any warping of the gymnasium floor or any other abnormality in the support structure for the bleacher section will not alter the uniformity of the vertical spacing between the seatboard-skirtboard combinations to preserve the asthetic beauty of the bleacher unit as viewed from the front when the bleacher sections are in the fully telescoped position.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a telescoping gymnasium seating unit, including a plurality of movable upright frame means respectively sized and movable between a first position wherein said frame means are nested one in the other when fully telescoped and a second position wherein said frame means are unnested, each of said frame means having horizontal support members and seating means thereon adjacent the front ends thereof with an upwardly facing, elongated and horizontally extending planar-like seating surface thereon and a horizontally facing skirtboard extending downwardly from the outwardly facing edge of said seating surface, each of said seating means on each of said frame means being vertically offset from a seating means on a mutually adjacent frame means in said second position of said frame means, the lower edges of said skirtboards being vertically spaced above said seating surfaces when said frame means is in said first position, the improvement comprising:

low friction means secured to said seating means and extending downwardly therefrom and engaging the upwardly facing seating surface of the next seating means located therebelow when said frame means are in said first position to maintain said vertical spacing uniform between said seating means when vertical loads are applied to said seating means when said frame means are in said first position.

2. The improvement according to claim 1, wherein said low friction means includes at least a pair of horizontally spaced rotatably supported rollers on all but the bottommost one of said seating means in said telescoping gymnasium seating unit.

3. The improvement according to claim 2, wherein each of said rollers includes a generally inverted U-shaped frame having a pair of parallel legs secured to said seating means and an axle secured to and extending between said legs and having a low friction material roller rotatably mounted on said axle between said legs.

4. The improvement according to claim 3, wherein said low friction means includes a frame member which is secured to the internal structure of said seating means and includes a horizontally extending protion spaced below said seating surface; and wherein said U-shaped frame is secured to said horizontally extending portion and extends downwardly therefrom, said low friction material roller resting on said upwardly facing seating surface of the next seating means positioned therebelow when said frame means is in said first position.

* * * * *